US005484303A

United States Patent [19]

Cheng

[11] Patent Number: 5,484,303

[45] Date of Patent: Jan. 16, 1996

[54] STRUCTURE OF A HUB

[75] Inventor: Dean Cheng, Hsin Chu, Taiwan

[73] Assignee: D-Link Corporation, Hsin Chu, Taiwan

[21] Appl. No.: 338,102

[22] Filed: Nov. 9, 1994

[51] Int. Cl.[6] ..... H01R 4/50

[52] U.S. Cl. ..... 439/345; 439/638; 439/540.1

[58] Field of Search ..... 439/345, 350, 439/369, 373, 490, 449, 527, 540.1, 638, 928, 929

[56] References Cited

U.S. PATENT DOCUMENTS 5,143,868 9/1992 Caveney et al. ..... 439/638 X 5,181,858 1/1993 Matz et al. ..... 439/188

5,217,394 6/1993 Ho ..... 439/638 X 5,227,953 7/1993 Lindberg et al. ..... 439/928 X

*Primary Examiner*—Khiem Nguyen

*Attorney, Agent, or Firm*—Jacobson, Price, Holman & Stern

[57] ABSTRACT

A hub for the distribution of a plurality of network signal transmission lines, including a base plate, and an upright hub body fastened to the base plate by swivel joint, wherein the base plate has a plurality of upright posts for stopping the electric plug of the power cable in place and for allowing the network signal transmission lines to be arranged in proper order and extended through the space defined between the upright posts.

4 Claims, 2 Drawing Sheets

STRUCTURE OF A HUB

BACKGROUND OF THE INVENTION

The present invention relates to a hub connected to power supply by a power cable for the distribution of a plurality of network signal transmission lines, which comprises a base plate and an upright hub body detachably fastened to the base plate by swivel joint, wherein the base plate has a plurality of upright posts for stopping the electric plug of the power cable in place and for allowing the network signal transmission lines to be arranged in proper order and extended through the space defined between the upright posts.

A conventional hub for use in a computer network system or the like for the distribution of a plurality of network signal transmission lines, is made of substantially rectangular shape for mounting on a table in a horizontal position. This structure of hub is still not satisfactory in function, because the electric plug may be disconnected from the hub body easily, when the electric cable which provides power supply to the hub is stretched, causing an interruption of signal transmission. Another drawback of this structure of hub is that it occupies much table space when installed. If to place the hub on the top surface of the table in a vertical position in order to reduce its space occupation, the hub may fall to the top surface of the table easily when it is touched or hit by an object. When the hub falls from a vertical position, its internal circuit may be damaged easily.

SUMMARY OF THE INVENTION

The present invention has been accomplished under the circumstances in view. It is one object of the present invention to provide a hub which is detachable. It is another object of the present invention to provide a hub which needs less installation space. According to one aspect of the present invention, the hub comprises a base plate having a top mounting hole, a plurality of mounting slots spaced around the mounting hole at a top side, and a plurality of upright posts disposed at one end, a hub body having a mounting rod raised from a bottom side thereof and a plurality of projecting strips radially extended from the mounting rod, wherein the hub body is fastened to the base plate by inserting the projecting strips into the mounting slots and then turning them sideways, permitting the mounting rod to be retained to the top mounting hole; when the hub body is fastened to the base plate, the upright posts are spaced from the hub body for holding the electric plug of the power cable between the hub body and one upright post.

According to still another aspect of the present invention, the upright posts of the base plate are spaced by a space for passing the network signal transmission lines, which are connected to respective receptacles on the hub body, and therefore the network signal transmission lines can be arranged in proper order and extended through the space between the upright posts.

DETAILED DESCRIPTION OF THE PREFERRED EMBODIMENT

Figure 1:
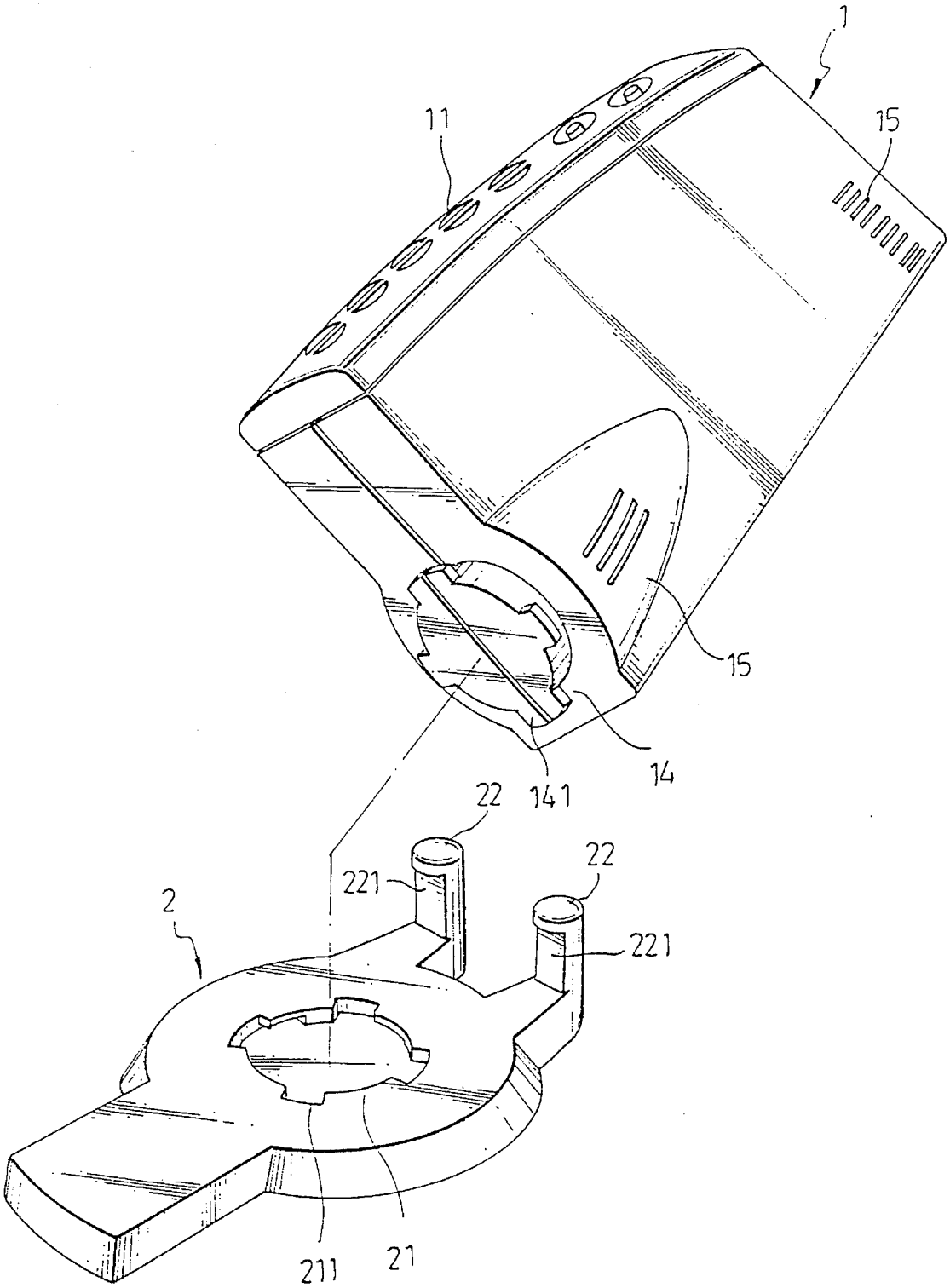
FIG. 1 is an exploded view of a hub according to the preferred embodiment of the present invention.
Figure 3:
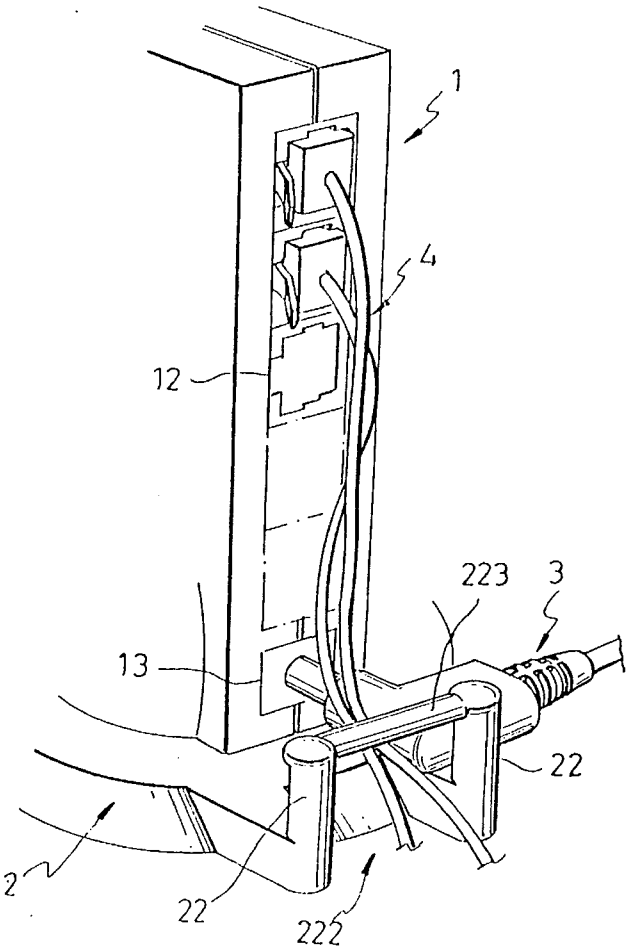
FIG. 3 is similar to FIG. 2 but showing a cross bar connected between the upright posts.
Figure 2:
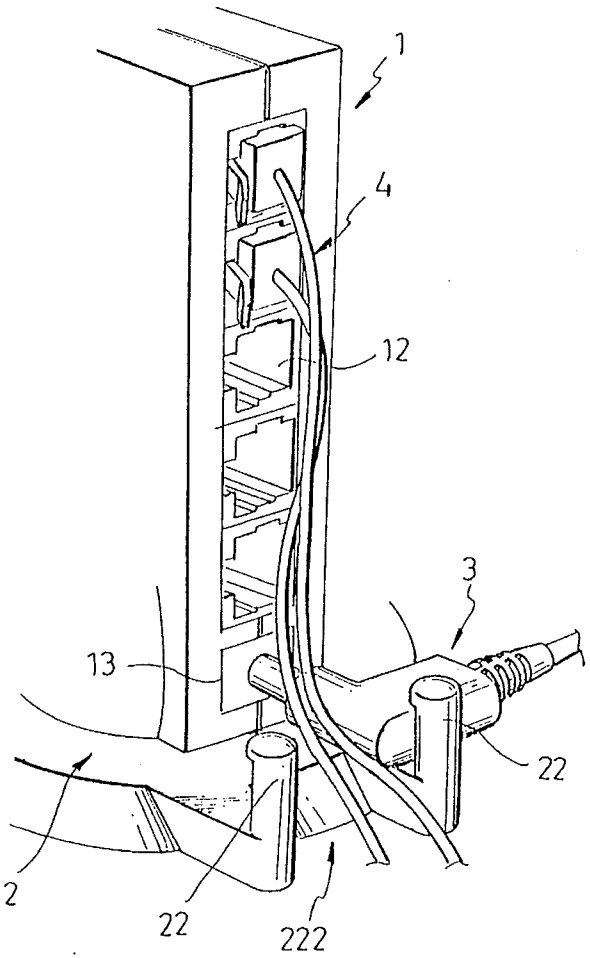
FIG. 2 shows the hub of FIG. 1 installed.

Referring to FIGS. 1, 2, and 3, a hub in accordance with the present invention is generally comprised of a hub body 1 and a base plate 2. The hub body 1 comprises a series of receptacles 12 longitudinally disposed at one side to which a plurality of network signal transmission lines 4 are connected respectively, a series of indicator lamps 11 electrically respectively connected to the receptacles 12, a power input socket 13, and a plurality of air vents 15 at suitable locations for dissipation of heat. When a network line 4 is connected to one receptacle 12, the corresponding indicator lamp 11 is turned on to give light.

Referring to FIGS. 1 and 2 again, the hub body 1 comprises a mounting rod 14 raised from the bottom side thereof, and a plurality of projecting strips 141 radially extended from the mounting rod 14. The base plate 2 comprises a top mounting hole 21 on the top side thereof, a plurality of mounting slots 211 spaced around the mounting hole 21 at the top, and two upright posts 22 bilaterally disposed at one end. Each upright post 22 has a longitudinal groove 221 at an inner side. By inserting the projecting strips 141 into the mounting slots 211 and then turning them sideways, the mounting rod 14 is fastened to the base plate 2. When in use, the power input socket 13 is connected to power supply by a power cable 3. When the electric plug of the power cable 3 is connected to the power input socket 13, it can be stopped at the longitudinal groove 221 of one upright post 22 of the base plate 2, and therefore the power cable 3 does not disconnect from the power input socket 13 when it is stretched. When network signal transmission lines 4 are fastened to the receptacles 12, the corresponding indicator lamps 11 are turned on to give a respective indication. The connected network signal transmission lines 4 can be arranged together and extended through the space 222 defined between the upright posts 22.

Referring to FIG. 3 again, a cross bar 223 is connected between the upright posts 22 at the top to keep the network signal transmission lines 4 arranged in good order.

While only one embodiment of the present invention has been shown and described, it will be understood that various modifications and changes could be made without departing from the spirit and scope of the invention.

What is claimed is:

1. A hub for distribution of a plurality of network signal transmission lines, comprising:

a hub body having at least one protrusion raised from a bottom side with a plurality of projecting strips radially extended from said at least one protrusion;

a base plate having at least one mounting hole on a top side of said plate with a plurality of mounting slots spaced around said mounting hole wherein said at least one protrusion can be accommodated into said at least one mounting hole;

at least one upright post disposed at one end on the top side of said base plate; and wherein when said hub body is fastened to said base plate, said at least one upright post is spaced from said hub body at a distance in which an electric plug of a the power cable can be fitted.

2. The hub of claim 1 wherein said at least one upright post has a longitudinal groove, which keeps the electric plug of the power cable in place.

3. The hub of claim 1 wherein two upright posts are disposed at either side of one end of said base plate.

4. The hub of claim 3 wherein two upright posts can be connected by a cross bar.

* * * * *